US005603170A

United States Patent [19]

Hirai

[11] Patent Number: 5,603,170

[45] Date of Patent: Feb. 18, 1997

[54] FIBER REINFORCED RESIN LIFT FOR SHOES

[75] Inventor: Giichi Hirai, Chiba, Japan

[73] Assignee: Hiro International Co., Ltd., Tokyo, Japan

[21] Appl. No.: 526,174

[22] Filed: Sep. 11, 1995

Related U.S. Application Data

[63] Continuation-in-part of Ser. No. 114,367, Sep. 1, 1993, abandoned.

[30] Foreign Application Priority Data

Sep. 3, 1992 [JP] Japan ..... 4-260705

[51] Int. Cl.[6] ..... A43B 21/00

[52] U.S. Cl. ..... 36/34 R; 36/34 A

[58] Field of Search ..... 36/34 A, 34 B, 36/34 R, 35 R, 35 A

[56] References Cited

U.S. PATENT DOCUMENTS

| | | | |
|---|---|---|---|
| 586,452 | 7/1897 | Norman | 36/59 A X |
| 2,102,901 | 12/1937 | Laursen | 36/35 R |
| 4,216,132 | 8/1980 | Himes et al. | 36/87 X |
| 4,231,169 | 11/1980 | Toyama et al. | 36/76 C X |
| 4,378,642 | 4/1983 | Light et al. | 36/35 R |
| 4,559,366 | 12/1985 | Hostettler | 36/25 R X |
| 4,564,966 | 1/1986 | Chen | 36/31 X |
| 4,651,445 | 3/1987 | Hannibal | 36/103 |
| 4,715,131 | 12/1987 | Kremendahl | 36/44 |
| 5,077,916 | 1/1992 | Beneteau | 36/31 X |
| 5,276,981 | 1/1994 | Schaffer et al. | 36/34 R |
| 5,298,313 | 3/1994 | Noland | 428/229 |
| 5,325,612 | 7/1994 | Lock et al. | 36/34 A X |

FOREIGN PATENT DOCUMENTS

| | | | |
|---|---|---|---|
| 1267214 | 6/1961 | France | 36/34 R |
| 1409879 | 7/1965 | France | 36/34 R |
| 2228916 | 9/1990 | Japan | 36/34 R |

*Primary Examiner*—B. Dayoan
*Attorney, Agent, or Firm*—Browdy and Neimark

[57] ABSTRACT

A lift for shoes is formed by injection molding a thermoplastic polyurethane resin which contains carbon fiber formed into linear pieces and cut to a predetermined length. This lift for shoes is a nonslip lift having a high abrasion resistance, a high impact resistance, a high moldability and a high operation efficiency concerning the production of shoes.

9 Claims, 2 Drawing Sheets

A- US TEST STANDARD VALUES

B- GENERAL LIFT

C- REINFORCED LIFT

D- LIFT ACCORDING TO THE PRESENT INVENTION

FIBER REINFORCED RESIN LIFT FOR SHOES

BACKGROUND OF THE INVENTION

This is a CIP of application Ser. No. 08/114,367, filed Sep. 1, 1993, now abandoned, the contents of which are hereby incorporated by reference.

1. Field of the Invention

This invention relates to a lift for shoes and more particularly to a nonslip resin lift for shoes, having a metal pin header fixed to the resin lift and having a high abrasion resistance, a high impact resistance, a high moldability, excellent cushioning properties and a high operation efficiency concerning the production of shoes.

2. Description of the Prior Art

A lift for shoes is a member which is provided on a heel, especially a woman's high-heel shoe, a portion of a shoe receiving the largest weight and having a small area, and which demands (1) a high abrasion resistance, (2) resistance to slippage and (3) a high impact resistance. However, the condition (1) and the conditions (2) and (3) have been found in the past to be incompatible with each other, i.e. when characteristic (1) is satisfied in a conventional lift for shoes, it is difficult to satisfy the characteristics (2) and (3); and, conversely, when characteristics (2) and (3) are satisfied, it is difficult to satisfy characteristic (1).

A lift for shoes is molded by mixing various kinds of organic materials together and subjecting the resultant mixture to a high-temperature heat treatment and a complicated step. Since it is necessary that a lift for shoes be molded to a small area, a satisfactory lift should satisfy not only the conditions (1)–(3) mentioned above but also the conditions including easy moldability and workability. Moreover, a satisfactory lift for shoes also demands a reduction of the manufacturing cost and an ability to be made by a method and in a mold which permit easy change so as to meet the need for diversification resulting from fashion changes in women's shoes.

However, there are no such lifts for shoes among conventional lifts for shoes that can meet these demands.

One conventional lift for shoes is manufactured by injection molding a thermoplastic polyurethane resin having a high impact resilience and a high abrasion resistance. Attempting to solve the above-mentioned problems and develop a lift of a higher quality for shoes using some other manufacturing method and material is difficult at present in view of the necessity of (a) reducing the manufacturing cost, (b) adapting a lift to the diversification of the shape of a heel, (c) improving the productivity, and (d) improving the operation efficiency concerning the production of shoes (in the production of shoes, insert lifts are mostly used). Therefore, the method of molding a thermoplastic polyurethane resin is necessarily followed.

The inventor of the present invention manufactured experimentally, in view of the conditions (a)–(d), a lift for shoes out of a material prepared by mixing glass fiber and Teflon powder with a thermoplastic polyurethane resin and melting the resultant mixture, but a product sufficiently satisfying the above-mentioned various conditions for a shoe lift could not be obtained.

As a material for a lift which satisfies nonslip and impact resistance, soft thermoplastic urethane resin having Shore A hardness of 88 to 93 is considered, but when a metal pin header is used together with the urethane resin, problems arise in suitably attaching the lift to the pin header, i.e. the bonding adhesive strength between the lift and the pin header is insufficient. Thus, the resin has a weak bonding strength to the pin header, and the pin header is easily separated from the lift.

However, a shoe lift which intends to improve impact resistance (cushioning properties) and nonslip has recently been manufactured in Italy by using soft polyurethane resin having hardness of 88 to 93. When such soft resin having the hardness of 88 to 93 is used, inconvenience occurs when the pin header is used as described above, so the Italian product uses two hard resin pins 10 instead of the pin header (FIG. 3). The hard resin pin 10 is hollow, has a flange 11 for inhibiting its removal from the lift, and is simultaneously vulcanized with the soft resin 12 for forming the lift. Therefore, the Italian product cannot be manufactured by a conventional general injection molding machine, but a particular molding machine must be made and used, and hence the cost of the lift becomes undesirably high.

SUMMARY OF THE INVENTION

An object of the present invention is to overcome deficiencies in the prior art, such as indicated above, and more particularly to provide a nonslip lift for shoes which solves the above-mentioned problems of a prior art lift of this kind, and which has a high abrasion resistance, a high impact resistance, a high moldability and a high operation efficiency concerning the production of shoes.

Another object of the present invention is to provide a lift for shoes, capable of obtaining a synergistic effect of the characteristics of a thermoplastic polyurethane resin including a high shock absorbability and a high slip-preventing capability and those of carbon fiber including a high conductivity, a high corrosion resistance and a high abrasion resistance.

Still another object of the present invention is to provide a lift for shoes, which has high bonding adhesive strength to a pin header of the lift and in which the pin header is not easily separated from the lift.

Still another object of the invention is to provide a lift for shoes which can be manufactured by a mass production by a general molding method and manufactured at a cost not much different from a conventional product.

Other and further objects, features and advantages of this invention will appear more fully from the following description.

The present invention is directed to a lift for shoes which is produced by injection molding a thermoplastic polyurethane resin, which consists substantially or entirely of a carbon fiber-containing thermoplastic polyurethane resin.

DESCRIPTION OF THE PREFERRED EMBODIMENTS

Figure 1:
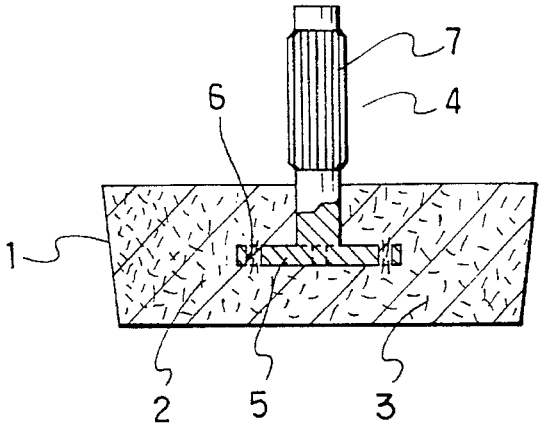
FIG. 1 is an enlarged sectional view of the lift for shoes according to the present invention.
Figure 2:
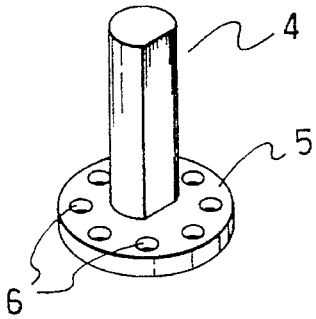
FIG. 2 is a perspective view showing another structural example of a pin header.
Figure 3:
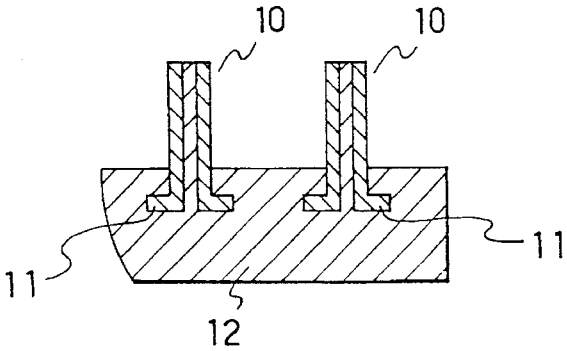
FIG. 3 (PRIOR ART)
FIG. 3 is an enlarged sectional view showing an example of a conventional lift For shoes (made in Italy)

FIG. 1 shows a lift 1 for shoes according to the present invention, which is produced by injection molding, according to a general method, a thermoplastic resin 2 containing broken carbon fibers 3. The illustrated lift 1 is cross-sectionally trapezoidal, but the cross-sectional shape thereof is not limited to this shape. The outer shape and size of the lift 1 can also be varied in accordance with the fashionable shape which the shoes demand. The lift 1 has an insert pin 4, but the lift 1 is not limited to this type of lift. The insert pin 4 has a flange 5 at the lower end of its shaft, and the flange 5 has a plurality of through holes 6. One or more longitudinal ribs 7 for stopping the pin 4 from being rotated (FIG. 1) may be provided along the shaft of the insert pin 4, and/or the pin may be chamfered (FIG. 2) by providing a flattened portion 8 or the like.

The inventor of the present invention considered simply in an initial stage of development of the lift 1, the possibility of utilizing the high rigidity and high elasticity of carbon fiber for the production of a lift. First, he ground carbon fiber to superfine powder and mixed the resultant powder with a polyurethane resin on the basis of his hypothetic ideal that, if carbon fiber is exposed on the outer surface of the polyurethane resin, the abrasion resistance of the resin would increase. However, scatter of composition of this mixture occurred during the agitation thereof due to the difference between the specific gravities of these two raw substances, and the expected degree of strength could not be obtained in the final product.

Therefore, according to the present invention, a carbon fiber assembly consisting of around 50 pieces of carbon fiber is cut to a predetermined length (for example, 8 mm) so as to improve the degree of mixing of these two kinds of substances, and the resultant carbon fiber is mixed with a polyurethane resin to prepare a material for a lift. The carbon fiber can be distributed uniformly by agitation-mixing this material so that the carbon fiber, initially consisting of around 50 pieces of carbon fiber, break into finer parts whereby each of the initial fibers becomes several pieces of carbon fiber.

A polyurethane resin having a hardness of 95–98 has been used in a conventional lift in view of its moldability and shoe-bonding strength. A polyurethane resin having such a high degree of hardness does not sufficiently satisfy the above-mentioned needed characteristics including slip resistance and impact resistance. The present invention, owing to the carbon fiber mixed therein, has succeeded in employing a urethane resin of a Shore A hardness of around 88–93, which had previously been unusable. According to the present invention, carbon fiber pieces cut to a predetermined length are mixed as mentioned above, with a polyurethane resin having a hardness of around 88–93 in a raw material preparing step, and the resultant mixture is agitation-mixed. The resultant mixture is then injection molded into a lift.

During the lift molding step in which the raw material is subjected to a high-pressure and high-temperature treatment, the heat is transmitted uniformly from the mold or die walls not only to the superficial layer of the molding material directly adjacent such walls, but also to the inner portion thereof owing to the heat conduction action of the carbon fibers. As a result, the inner portion of the lift is hardened to the same or substantially the same level as the surface layer thereof.

According to the present invention, the quantity of carbon fiber contained in a polyurethane resin is preferably in the range of 1.0–10.0 wt. %, more preferably 2.0–4.0 wt %, and most preferably about 2.9 wt %. When the quantity of carbon fiber is less than 1.0 wt. %, the abrasion resistance of a final product becomes insufficient, and when the quantity of carbon exceeds 10.0 wt. %, the resultant lift becomes liable to slip and has an insufficient shock absorbability.

The length of the carbon fiber used in the present invention is in the range of 0.1–10.0 mm, and preferably is initially around 2–6 mm, most preferably 2–4 mm. When the length of the carbon fiber is set to less than 1 mm, it causes only an increase in the carbon fiber cutting and pulverizing costs, and no improvement of any desirable effects can be obtained. When the length of the carbon fiber is set in excess of 10.0 mm, the moldability of a thermoplastic polyurethane resin lowers.

In the lift for shoes according to the present invention, the chopped carbon fiber is mixed in with a thermoplastic polyurethane resin, which is an elastic material, as mentioned above, and therefore the characteristics of the polyurethane resin and those of the carbon fiber are displayed in a mixed manner to enable a synergistic effect of these materials to be obtained. Namely, the lift for shoes according to the present invention consists of a rigid composite body of a high impact resilience having a high abrasion resistance and an excellent anti-static effect provided by the high shock absorbability and excellent slip-preventing capability of the polyurethane resin and the high conductivity, high corrosion resistance and high abrasion resistance of the carbon fiber.

The lift for shoes according to the present invention has a hardness of around 90–94, a tensile elastic modulus of around 10–16 MPa, a tensile strength of around 25–40 MPa and a tear strength of around 10–15 KN/m. Owing to these characteristics, the lift for shoes according to the present invention has an abrasion resistance several times as high as that of a conventional lift for shoes, as well as a high elasticity, a high impact resistance and a high slip resistance. The lift for shoes according to the present invention surpasses by a wide margin the US Standards for a shoe lift, which stipulate that a metal pin (header) shall not be exposed in terms of abrasion thereof after a 10-mile walk wearing shoes (with lifts).

Figure 4:
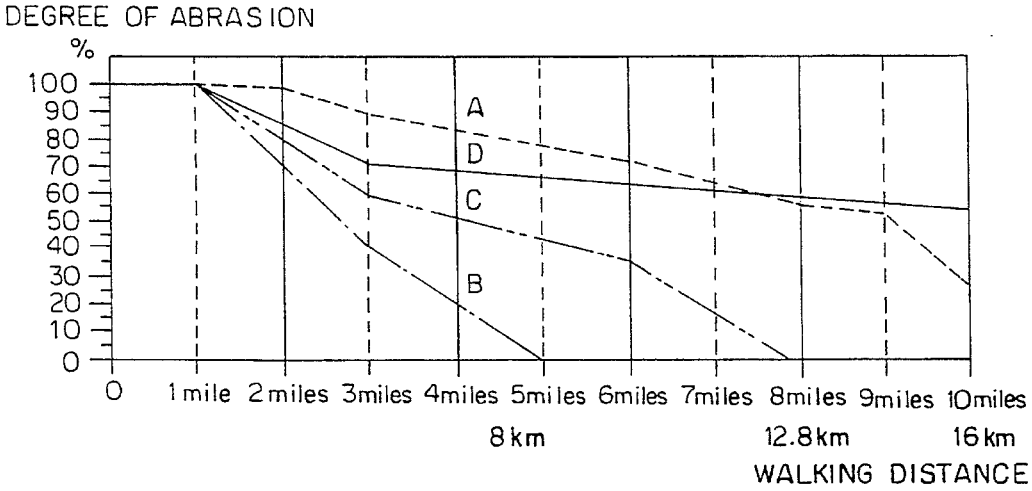
FIG. 4 is a graph showing the results of tests on durability of the lift for shoes according to the present invention and a general type lift for shoes.
Figure 5:
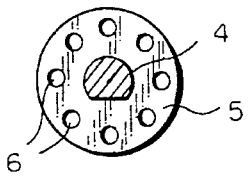
FIG. 5 is a cross-sectional view of the pin of FIG. 2.

FIG. 4 is a graph showing the results of a 16 km walk durability test among (D) a lift according to the present invention containing 2.9% carbon fiber initially cut to a length of 3.0 mm, (B) a generally-used lift and a (C) generally-used reinforced lift. This test was conducted on the basis of the US Heel Lift Test Standards, and US Test Standard Values are also shown (curve A) in the drawing for reference. As is clear from this graph, the lift D according to the present invention has a durability far higher than those of the general lift B and reinforced lift C and higher than even the US Test Standard Values A beyond the walking distance of 7.5 miles.

The following table shows the results of comparative abrasion tests on the aforementioned lift according to the present invention and the products (lifts) of some companies other than the inventor's company. These tests were conducted by manually rubbing a tester to which a lift is attached against an abrasion test sheet, and counting the number of this rubbing actions until the lift has been so worn as to cause a header to be exposed.

| Name of product | Result of tests (Average value) |
|---|---|
| A company, general lift (5 mm thick) | Header was exposed after the lift was rubbed 20 times. |
| A company, reinforced Lift (5 mm thick) | Header was exposed after the lift was rubbed 20 times. |
| B company, reinforced lift (5 mm thick) | Header was exposed after the lift was rubbed 13 times. |
| B company, reinforced lift (5 mm thick) | Header was exposed after the lift was rubbed 20 times. |
| C company, reinforced lift (5 mm thick) | Header was exposed after the lift was rubbed 30 times. |
| C company, reinforced lift (5 mm thick) | Header was exposed after the lift was rubbed 40 times. |
| Lift according to the present invention (5 mm thick) | Header was exposed after the lift was rubbed 105 times. |

According to the present invention, the carbon fiber 3 mixed in the polyurethane resin 2 of the lift I is entangled with the insert pin 4, and hence the bonding adhesive strength of the lift 1 to the insert pin 4 is increased, and the resultant insert pin 4 is firmly anchored and can hardly be removed. That is, the plurality of through holes are formed at the flange 5 of the insert pin 4, and the polyurethane resin 2 extends through the through holes 6 at the time of injection molding. In this case, the carbon fiber 3 in the polyurethane resin 2 is entangled with the outer peripheral edge of the flange 5 and the inner peripheral edges of the holes 6, and, therefore, the flange 5 is rigidly held. Therefore, the insert pin 4 is firmly anchored within the shoe lift 1.

The following data and recommendations are abstracts from a report concerning the lift according to the present invention of SATRA (Shoe and Allied Trades Research Association) in England which is most authorized as a research institute concerning shoes. The usefulness of the aforementioned lift of the present invention containing 2.9% carbon fibers can be recognized from the content of this report as follows:

| Test Data | |
|---|---|
| Hardness (ASTM D2240 1981) | 46 Shore D |
| Density (*BS903 Part A1 1980 (1988) Mtd A)) | $1.20^{-}/cm^3$ |
| Abrasion Resistance (*BS 903 Part A9 1988 Mtd A1 = *DIN 53516 1987) | 32 $mm^3$ |
| Predicted Specific Durability (SATRA formula) | 3.5 |
| Slip Resistance (SATRA PM 144 9992) | Dry 0.45 Coeff. of Friction<br>Wet 0.41 Coeff. of Friction |
| Attachment strength to spigot head (*SATRA PM.108 1992) | 2.51 N (NB also spigot dependent) |

Recommendations

This is a relatively soft grade of material compared to those traditionally used in spigotted top-lifts. The abrasion resistance is very good and the predicted durability is high. Slip resistance is as high as can be expected for this type of component and is satisfactory for normal conditions of use. Spigotted attachment strength is potentially very good with an appropriated spigot. The material is recommended for women's moulded heel top-lifts.

The present invention has various other types of modified examples as a matter of course. For example, the ground contacting surface of the lift for shoes may be provided with projections and recesses, or the carbon fiber content of the lift for shoes may not be set uniform but may be set to a higher level within the mentioned range in a ground contacting surface portion thereof. Accordingly, the modified examples within the true concept and scope of the present invention are included in the claims thereof.

What is claimed is:

1. A lift for shoes comprising a thermoplastic polyurethane resin containing carbon fiber in linear pieces cut to a predetermined length in the range of 0.1–10.0 mm, said thermoplastic polyurethane resin containing said carbon fiber in the range of 1.0–10.0 wt. %, said lift having been formed by injection molding of said thermoplastic polyurethane containing said carbon fiber.

2. A lift for shoes according to claim 1, wherein the specific gravity of said carbon fiber is substantially equal to that of said thermoplastic polyurethane resin.

3. A lift for shoes according to claim 1, wherein said thermoplastic polyurethane resin has a shore A hardness in the range of 88–93.

4. A lift for shoes according to claim 1, wherein the 100% tensile elastic modulus of said lift is in the range of 10–16 MPa.

5. A lift for shoes according to claim 1, wherein the tensile strength of said lift is in the range of 25–40 MPa.

6. A lift for shoes according to claim 1, wherein the tear strength of said lift is in the range of 10–15 KN/m.

7. A lift for shoes according to claim 1, further comprising an insert pin having a flange formed with a plurality of through holes at a lower part thereof within said lift.

8. A lift according to claim 7, wherein said insert pin has a shaft projecting from said lift, said shaft having an irregular cross-sectional shape.

9. A lift according to claim 7, wherein said thermoplastic polyurethane has a Shore A hardness of 88–93, and said lift has a tensile elastic modulus of about 10–16 MPa, a tensile strength of about 25–40 MPa, a tear strength of about 10–15 KN/m, and a Shore A hardness of about 90–94.

* * * * *